US005873957A

United States Patent [19]

Bano et al.

[11] Patent Number: 5,873,957

[45] Date of Patent: Feb. 23, 1999

[54] HOT-ROLLED SHEET STEEL FOR DEEP DRAWING

[75] Inventors: Xavier Bano, Istres; Christian Giraud, Miramas, both of France

[73] Assignee: Sollac, Puteaux, France

[21] Appl. No.: 933,349

[22] Filed: Sep. 19, 1997

[30] Foreign Application Priority Data

Sep. 19, 1996 [FR] France ..... 96 11413

[51] Int. Cl.[6] ..... C22C 38/06; C22C 38/08; C21D 8/04

[52] U.S. Cl. ..... 148/330; 148/332; 148/654; 148/661; 420/92; 420/121

[58] Field of Search ..... 148/332, 330, 148/654, 661; 420/92, 121

[56] References Cited

U.S. PATENT DOCUMENTS 4,080,225 3/1978 Semel .
5,454,883 10/1995 Yoshie et al. ..... 148/654

FOREIGN PATENT DOCUMENTS 0 320 003 6/1989 European Pat. Off. .
0 620 289 10/1994 European Pat. Off. .
21 33 744 1/1973 Germany .

OTHER PUBLICATIONS

Patent Abstracts of Japan, vol. 096, No. 004, Apr. 30, 1996 and JP 07 316649 A.

*Primary Examiner*—Deborah Yee
*Attorney, Agent, or Firm*—Oblon, Spivak, McClelland, Maier & Neustadt, P.C.

[57] ABSTRACT

A hot-rolled sheet steel for deep drawing, characterized in that it has the following composition:

| | |
|---|---|
| carbon | >0.010 wt. % and <0.080 wt. % |
| manganese | >0.1 wt. % and <0.5 wt. % |
| aluminum | >0.02 wt. % and <0.08 wt. % |
| silicon | <0.1 wt. % |
| phosphorus | <0.04 wt. % |
| sulfur | <0.025 wt. % |
| titanium | <0.05 wt. % |
| nitrogen | <0.009 wt. % |
| boron | >0.001 wt. % and <0.01 wt. % |
| copper | >0.1 wt. % and <0.8 wt. % |
| nickel | >0.05 wt. % and <0.6 wt. %. |

9 Claims, 3 Drawing Sheets

HOT-ROLLED SHEET STEEL FOR DEEP DRAWING

BACKGROUND OF THE INVENTION

1. Field of the Invention

The invention relates to a hot-rolled sheet steel especially useful for deep drawing, said sheet preferably being produced on a strip mill.

2. Discussion of the Background

The forming properties of steels are important in the production of deep-drawn articles having complex shapes. Among the available types of hot-rolled sheets or plates with mechanical properties obtained by controlled rolling on a wide strip rolling mill, the steels having the best deep-drawing properties are those designated as "3C" and "3C Ti".

These steels have in their compositions carbon, manganese, titanium, and certain trace elements which contribute to the desired mechanical properties. Their content of gamma-genic elements (e.g. carbon and manganese) is so high that their ferritic transformation temperature is relatively low; e.g. the AR3 transformation temperature is 840° C. at a thickness of 4.5 mm. In order to avoid rolling in the biphase austenitic-ferritic domain, which would result in markedly inferior forming properties, the rolling temperature must be above 840° C., i.e. must be in the austenitic domain.

In practice, a sheet comprised of these steels may be subjected to continuous coating on a galvanization line, to provide corrosion protection. This coating method tends to subject the sheet to a thermal cycle which results in an increase in the elastic limit of the steel and a reduction in its elongation at fracture.

OBJECTS OF THE INVENTION

One object of the invention is to devise a sheet steel having excellent forming properties for deep drawing, which sheet steel will have comparably good properties after cold rolling and after continuous galvanization.

SUMMARY OF THE INVENTION

The principal subject matter of the invention which meets the above object is a hot- rolled steel, preferably in sheet form, characterized by the following composition:

| | |
|---|---|
| carbon | >0.010 wt. % and <0.080 wt. % |
| manganese | >0.1 wt. % and <0.5 wt. % |
| aluminum | >0.02 wt. % and <0.08 wt. % |
| silicon | <0.1 wt. % |
| phosphorus | <0.04 wt. % |
| sulfur | <0.025 wt. % |
| titanium | <0.05 wt. % |
| nitrogen | <0.009 wt. % |
| boron | >0.001 wt. % and <0.01 wt. % |
| copper | >0.1 wt. % and <0.8 wt. % |
| nickel | >0.05 wt. % and <0.6 wt. %, |

the remainder preferably being mostly, preferably completely, iron and impurities resulting from production. In a preferred embodiment the invention nickel content is approximately (±10%) one half of the copper content.

The invention also relates to a method of fabricating a hot-rolled sheet steel for deep drawing, whereby, after production, the steel material is subjected to:

hot rolling at a temperature above the temperature of the AR3 transformation;

cooling to a lower temperature range, at 10 seconds or less following the hot rolling, at a rate in the range of 3° C./sec to 80° C./sec, with ultimate cooling to a temperature in the range 600–750° C.

A preferred embodiment of the process of the invention is:

the hot rolling is carried out at a temperature of 10°–120° C. above the AR3 transformation temperature.

The further description which follows, along with the accompanying drawings, are offered by way of example, to better convey an understanding of the invention, but do not limit the scope of the invention.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

The invention hot-rolled sheet steel for deep drawing has the following composition:

| | |
|---|---|
| carbon | >0.010 wt. % and <0.080 wt. % |
| manganese | >0.1 wt. % and <0.5 wt. % |
| aluminum | >0.02 wt. % and <0.08 wt. % |
| silicon | <0.1 wt. % |
| phosphorus | <0.04 wt. % |
| sulfur | <0.025 wt. % |
| titanium | <0.05 wt. % |
| nitrogen | <0.009 wt. % |
| boron | >0.001 wt. % and <0.01 wt. % |
| copper | >0.1 wt. % and <0.8 wt. % |
| nickel | >0.05 wt. % and <0.6 wt. % |
| remainder: | iron, and impurities inherent in the process. |

The invention steel enables a homogeneous ferrite cementite structure to be achieved. The transformation temperature is lowered by the elements copper, nickel, and boron, without hardening of the structure.

DETAILED DESCRIPTION OF THE PREFERRED EMBODIMENTS

Various other objects, features and attendant advantages of the present invention will be more fully appreciated as the same becomes better understood from the following detailed description when considered in connection with the accompanying drawings.

Figure 1:
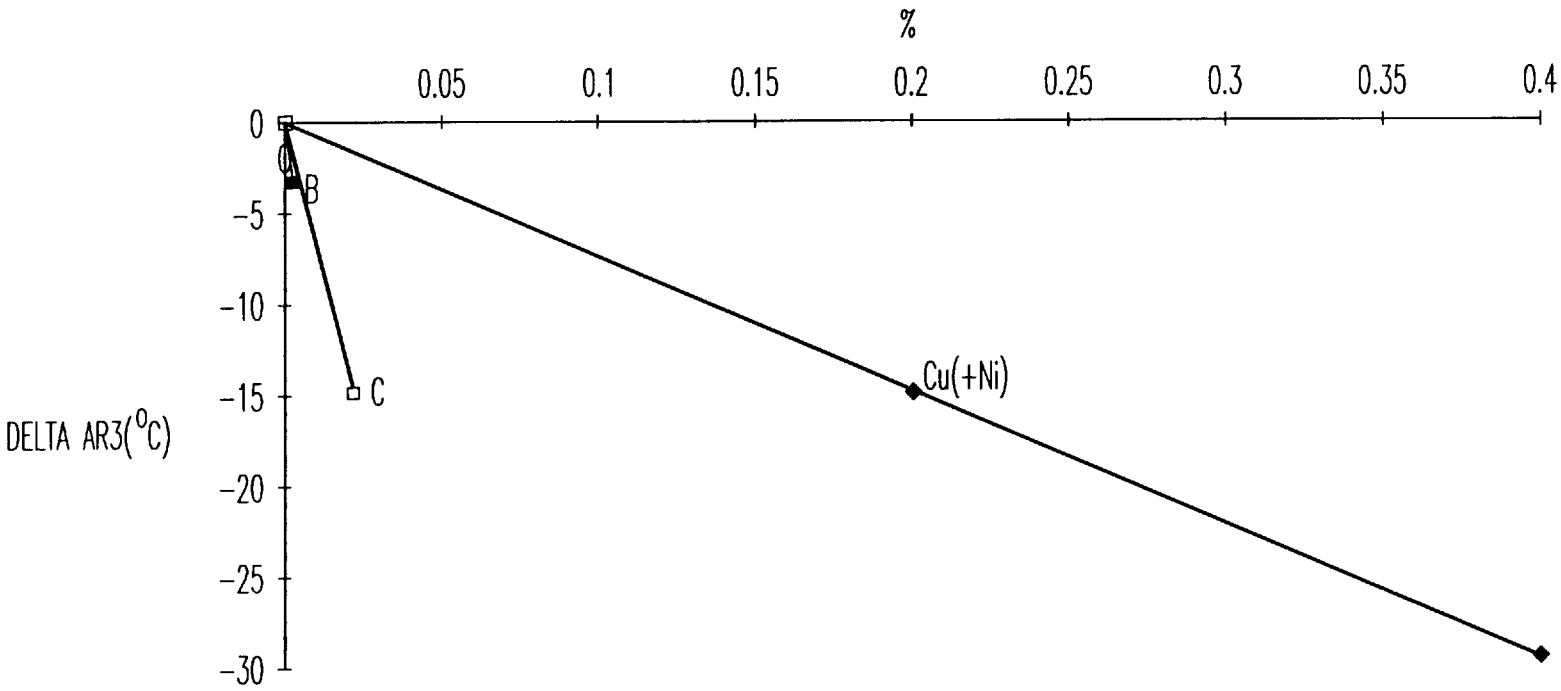
FIG. 1 illustrates the effect of the content of carbon, boron, copper, and nickel on the lowering of the transformation temperature AR3.

FIG. 1 illustrates the effect of the content of carbon, boron, copper, and nickel on the lowering of the transformation temperature AR3. The addition of nickel in an amount such that the nickel content is one half the copper content is preferred and avoids surface defects in the sheet. The copper and nickel present also provide the steel sheet with increased corrosion resistance.

The carbon, at a content of less than 0.08 wt. %, enables good forming characteristics to be achieved. The low carbon content ensures that the hardening of the matrix will be limited, due to a low content of carburized phases.

The principal function of the titanium is believed to be to combine with nitrogen to form precipitates of titanium nitride which are very stable during the course of the solidification of the steel. The titanium in stoichiometric excess (3.4<Ti/N<10), precipitates in the form of titanium carbide, in the course of the cooling, and thereby sequesters part of the carbon in the steel. The ratio of Ti to N is preferably below 10, to avoid hardening due to precipitation of titanium carbide.

Thus, the titanium content should be limited so as to avoid hardening caused by the precipitates. At an elevated content in the interval indicated, the titanium precipitated as TiC may be advantageous for the steel if the steel is to be enameled, because it enables preservation of the mechanical characteristics of the material after the forming of the sheet and the thermal treatment associated with the enameling.

A noteworthy function of the boron is to control germination and growth of ferrite, thereby enabling good forming properties to be achieved, characterized in particular by greater elongation of the steel. The boron forms borocarbides with carbon, which precipitate or are segregated at grain boundaries.

In the steel according to the invention, containing boron, the temperature where ferritic transformation begins is decreased if the rolling temperature is increased. This phenomenon allows the ferritic transformation temperature to be lowered appreciably, thereby avoiding biphase rolling, rolling below the temperature of the ferrite-bainite transformation. Biphase rolling leads to surface defects of the "orange peel" type, which are connected with an increase in the ferritic grain size; and again the resulting forming characteristics are inferior. The phenomenon also allows one to decrease the carbon content and manganese content, thereby improving the forming characteristics due to a more yielding (softer) structure, with a larger ferritic grain size and thereby a greater elongation without the risk of biphase rolling.

Figure 2:
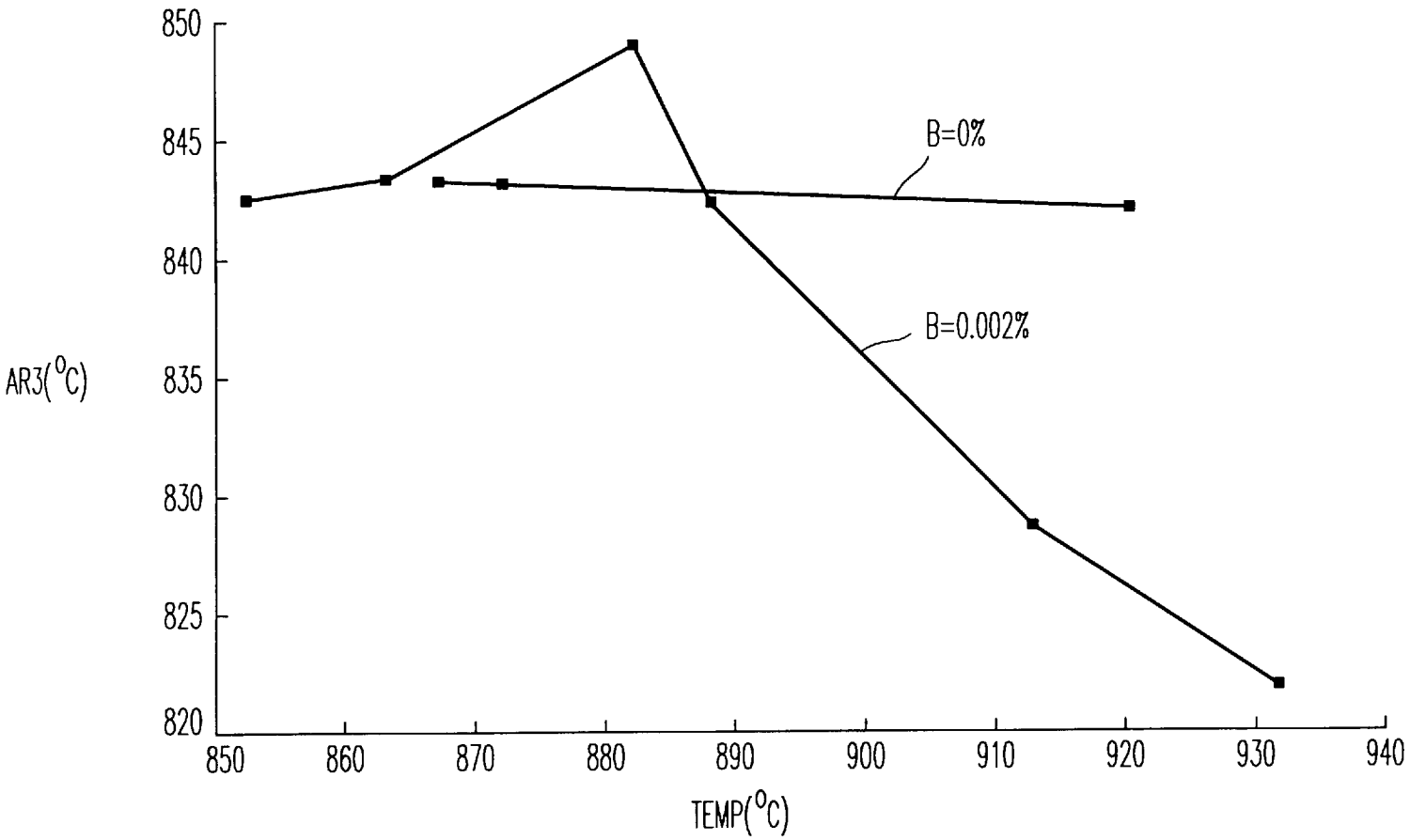
FIG. 2 illustrates the relationship between AR3 and rolling temperature, for a steel containing 0.002 wt. % boron and a steel containing no boron where $T_{lam}$ is the temperature of rolling.

FIG. 2 shows curves of AR3 as a function of rolling temperature, for a steel containing 0.002 wt. % boron and a steel containing no boron.

As seen from FIG. 2, the boron enables advantages with regard to the temperature of onset of ferritic transformation, if one provides certain temperatures at the end of the rolling.

The combination of titanium and boron enables precipitation of titanium and boron to preserve the mechanical characteristics obtained after hot rolling, such that these properties are not degraded during the thermal treatment on the galvanizing line.

The rolling temperature is chosen to be 10°–20° C. above the transformation temperature AR3, so as to avoid rolling in the austenitic-ferritic domain which is detrimental to the forming characteristics.

Figure 3:
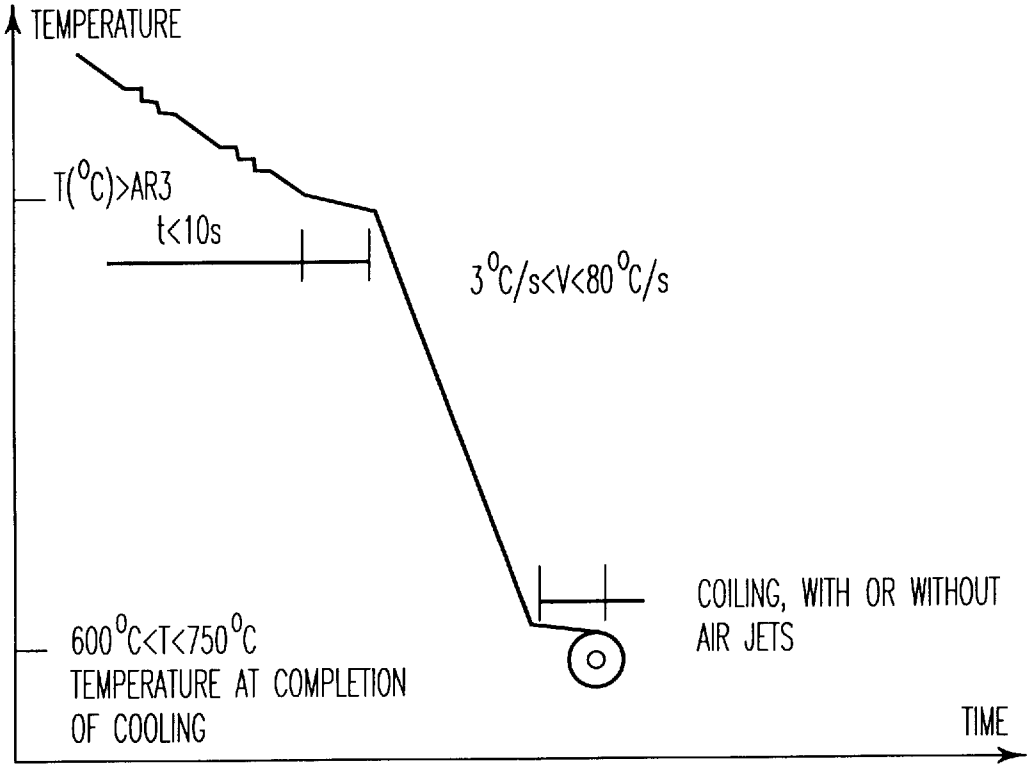
FIG. 3 illustrates the course of treatment of the sheet as it is being fabricated.

FIG. 3 illustrates the course of thermal treatment of the sheet during fabrication. A time interval less than 10 sec is needed prior to the first cooling. This cooling is carried out at a rate of 3°–80° C./sec, including 10°, 20°, 30°, 40°, 50°, 60°, and 70° C./sec depending on the thickness of the rolled sheet (e.g.,m 0.01–100 mm, preferably 0.1–10 mm); this provides a controlled, homogeneous germination of ferrite. After the sheet is cooled to a temperature between 600° and 750° C., the final structure, comprised of ferrite cementite, provides mechanical strength in the range 250–370 MPa, an elastic limit in the range 180–280 MPa, and elongation at fracture greater than 30%.

EXAMPLES

As an example of the invention, a hot-rolled sheet steel for deep drawing was fabricated from a steel having the following composition:

| | |
|---|---|
| carbon | >0.020 wt. % and <0.040 wt. % |
| manganese | >0.15 wt. % and <0.25 wt. % |
| aluminum | >0.02 wt. % and <0.04 wt. % |
| silicon | <0.2 wt. % and 0.04 wt. % |
| phosphorus | <0.02 wt. % |
| sulfur | <0.005 wt. % |
| titanium | <0.02 wt. % |
| nitrogen | <0.009 wt. % |
| boron | >0.002 wt. % and <0.004 wt. % |
| copper | >0.35 wt. % and <0.45 wt. % |
| nickel | >0.18 wt. % and <0.23 wt. % |
| remainder: | iron and impurities from production. |

The hot rolling temperature was chosen at the transformation temperature AR3 plus 20° C. Cooling was begun 1.5 seconds following the hot rolling, and was accomplished at the rate of 30° C. per second, until a temperature of 680° C. was reached. It was possible to achieve an elongation at fracture of hot-rolled sheet steel according to the invention of 36% for sheet of thickness 1.8–2.8 mm; and an elongation at fracture of 40% for sheet of thickness 3–8 mm.

Two other compositions of steel sheet according to the invention are presented in Table 1:

TABLE 1

| | C | Mn | Cu | Ni | Al | Ti | N | B |
|---|---|---|---|---|---|---|---|---|
| Sheet A | 0.044 | 0.274 | 0.406 | 0.214 | 0.031 | 0.021 | 0.0042 | 0.0027 |
| Sheet B | 0.040 | 0.267 | 0.202 | 0.098 | 0.028 | 0.019 | 0.0042 | 0.0020 |

The temperature at the start of the ferritic AR3 transformation was 818° C. for Steel A, and 842° C. for Steel B.

The thermomechanical treatment of the two inventive sheets comprised hot rolling at 900° C. and coiling at 700° C., wherewith the cooling was carried out at a rate of 25° C./sec.

The mechanical characteristics of the two exemplary sheets (A and B) are set forth in Table 2.

TABLE 2

| | Re (MPa) | Rm (MPa) | Elongation at Fracture (%) |
|---|---|---|---|
| Sheet A | 246 | 344 | 43 |
| Sheet B | 244 | 328 | 43.4 |

Table 3 presents for Sheet A the so-called "raw" mechanical characteristics obtained prior to the thermal treatment involved in galvanization, and the mechanical characteristics obtained after thermal treatment in galvanization at 700° C. and 600° C., respectively.

TABLE 3

| | Raw Sheet | 700° C. | 600° C. |
|---|---|---|---|
| Re (MPa) | 246 | 262 | 246 |
| Rm (MPa) | 344 | 350 | 348 |
| A (%) | 43 | 43.3 | 36.3 |

The conditions of thermal treatment in the course of the continuous galvanization were as follows:

The rate of temperature increase was in the range 3°–20° C./sec, generally being 8° C./sec. The holding temperature was 550°–850° C., with the flow temperature being 700° C. The holding time was 20–120 sec, preferably 60 sec. The said temperature increase was followed by cooling at a rate of 3°–25° C./sec, typically 10° C./sec. The cooling was to the temperature of the galvanizing bath, viz. to 450° C.

The mechanical characteristics of the sheet steel according to the invention, at thicknesses in the range 1.5 to 8 mm, were not significantly different after galvanization from the characteristics determined before galvanization but after the basic hot rolling.

French patent application 96 11 413 filed Sep. 19, 1996, is incorporated herein by reference.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by letters patent of the United States is:

1. A hot-rolled sheet steel comprising the following elements based on total weight:

| | |
|---|---|
| carbon | >0.010 wt. % and <0.080 wt. % |
| manganese | >0.1 wt. % and <0.5 wt. % |
| aluminum | >0.02 wt. % and <0.08 wt. % |
| silicon | >0.1 wt. % |
| phosphorus | <0.04 wt. % |
| sulfur | <0.025 wt. % |
| titanium | <0.05 wt. % |
| nitrogen | <0.009 wt. % |
| boron | >0.001 wt. % and <0.01 wt. % |
| copper | >0.1 wt. % and <0.8 wt. % |
| nickel | >0.05 wt. % and <0.6 wt. %; and |

iron and impurities inherent in processing, wherein the nickel content of the steel is approximately one half of the copper content.

2. The sheet steel according to claim 1, having the following composition:

| | |
|---|---|
| carbon | >0.020 wt. % and <0.040 wt. % |
| manganese | >0.15 wt. % and <0.25 wt. % |
| aluminum | >0.02 wt. % and <0.04 wt. % |
| silicon | >0.02 wt. % and <0.04 wt. % |
| phosphorus | <0.02 wt. % |
| sulfur | <0.005 wt. % |
| titanium | <0.02 wt. % |
| nitrogen | <0.009 wt. % |

-continued

| | |
|---|---|
| boron | >0.002 wt. % and <0.004 wt. % |
| copper | >0.35 wt. % and <0.45 wt. % |
| nickel | >0.18 wt. % and <0.23 wt. %; and |

iron and impurities inherent in processing.

3. The sheet steel of claim 1, wherein the ratio of titanium to nitrogen is below 10.

4. The sheet steel of claim 1, wherein said steel is comprised of ferrite cementite.

5. The sheet steel of claim 1, wherein said steel has a mechanical strength of 250–370 MPa.

6. A method of fabricating a sheet steel wherein steel comprising the following elements based on total weight:

| | |
|---|---|
| carbon | >0.010 wt. % and <0.080 wt. % |
| manganese | >0.1 wt. % and <0.5 wt. % |
| aluminum | >0.02 wt. % and <0.08 wt. % |
| silicon | >0.1 wt. % |
| phosphorus | <0.04 wt. % |
| sulfur | <0.025 wt. % |
| titanium | <0.05 wt. % |
| nitrogen | <0.009 wt. % |
| boron | >0.001 wt. % and <0.01 wt. % |
| copper | >0.1 wt. % and <0.8 wt. % |
| nickel | >0.05 wt. % and <0.6 wt. %; and |

iron and impurities inherent in processing wherein the nickel content of the steel is approximately one half of the copper content is subjected to the following steps:

hot rolling at a temperature above the temperature of the AR3 transformation;

cooling to a lower temperature range, within 10 seconds or less following the hot rolling, at a rate in the range of from 3 ° C./sec to 80° C./sec, with ultimate cooling to a temperature in the range of 600°–750° C.

7. The method according to claim 6, wherein hot rolling is carried out at a temperature 10°–120° C. above the transformation temperature AR3.

8. The sheet steel according to claim 1, wherein the nickel content of the steel is one half of the copper content.

9. The method according to claim 6, wherein the nickel content of the steel is one half of the copper content.

* * * * *